United States Patent [19]

Beales

[11] Patent Number: 5,020,921

[45] Date of Patent: Jun. 4, 1991

[54] PAPERBOARD PARTITION

[75] Inventor: Jonathan T. Beales, Philadelphia, Pa.

[73] Assignee: International Paper Company, Purchase, N.Y.

[21] Appl. No.: 561,753

[22] Filed: Aug. 2, 1990

[51] Int. Cl.[5] ..... B65D 30/22

[52] U.S. Cl. ..... 383/38; 229/120.29; 229/120.37

[58] Field of Search ..... 383/38; 229/120.06, 229/120.24, 120.26, 120.27, 120.28, 120.29, 120.37, 120.38, 120.23; 206/427

[56] References Cited

U.S. PATENT DOCUMENTS

| | | | |
|---|---|---|---|
| 1,849,083 | 3/1932 | Grimes | 217/22 X |
| 1,983,418 | 12/1934 | Thurmer | 383/38 X |
| 2,830,749 | 4/1958 | Lauritzen | 229/120.29 |
| 3,384,289 | 5/1968 | Grant | 229/120.29 |
| 3,963,171 | 6/1976 | Lindsay | 229/120.23 |
| 3,971,468 | 7/1976 | Helms et al. | 229/120.27 X |
| 4,077,561 | 3/1978 | Gardner | 229/120.29 |
| 4,534,504 | 8/1985 | Locke | 229/120.29 |
| 4,542,826 | 9/1985 | Adams | 383/38 X |
| 4,819,793 | 4/1989 | Willard et al. | 383/40 X |
| 4,869,599 | 9/1989 | Allen | 383/38 |

FOREIGN PATENT DOCUMENTS

| | | | |
|---|---|---|---|
| 132096 | 1/1985 | European Pat. Off. | 229/120.27 |

*Primary Examiner*—Stephen P. Garbe
*Assistant Examiner*—Jes F. Pascua
*Attorney, Agent, or Firm*—Michael J. Doyle; Walt Thomas Zielinski

[57] ABSTRACT

A paperboard partition having particular utility as a partition for spacing and supporting items in a paper bag or any suitable holder is formed from a unitary blank of paperboard. The blank is die cut and provided with a plurality of fold lines. The die cuts define a plurality of locking tabs and also define apertures for receiving the locking tabs when the partition is erected. Two of the panels defined by the fold lines and die cuts are each provided with a spot of glue or other adhesive. Upon initial folding of the blank those panels, termed adhesive panels, which have been provided with glue spots, are attached to corresponding panels. The partition is formed in such a manner that it is collapsed to flat configuration for shipment and/or storage. For use, the user erects the folded partition by unfolding, i.e., spreading several of the panels apart from each other, with the partition then being placed into a paper bag or other holder. The partition defines two diagonally located cells, with each cell having a bottom shelf of at least partial double thickness. Upon erection, the uppermost of each bottom shelf panel becomes latched or locked, by virtue of a locking tab carried thereby becoming engaged with a respective locking aperture.

7 Claims, 2 Drawing Sheets

PAPERBOARD PARTITION

BACKGROUND OF THE INVENTION

This invention relates to a paperboard partition of unitary construction which is adapted to be placed inside a paper bag for the purpose of spacing and supporting items within the bag. It may also be used as a partition in any type of container, such as a paperboard carton or other suitable holder.

This art is already aware of similar constructions, such as shown in U.S. Pat. Nos. 4,869,599 issued to Allen, 3,963,171 issued to Lindsay, and also 1,849,083 issued to Grimes. While operative for spacing elements such as beverage containers within a paper bag, these prior constructions do not exhibit the simplicity of construction or of operation of the partition of this invention. In Allen, for example, his holder (termed a drink cup support) is erected by unfolding from a flat, folded configuration, as shown at his FIG. 3. While the present invention also erects from a flat, folded configuration, it is formed from a single paperboard blank, while Allen requires several separate panels which must be assembled to form his support.

SUMMARY OF THE INVENTION

According to the practice of this invention, a paperboard partition, such as for spacing and supporting items in a paper bag or the like, is fashioned from a unitary blank of paperboard which is die cut, glued and shipped in a collapsed condition. The partition is erected from its flattened or collapsed form by unfolding it, whereupon tabs engage complementary slots to automatically lock the partition in the erected configuration.

DETAILED DESCRIPTION OF THE INVENTION

Figure 1:
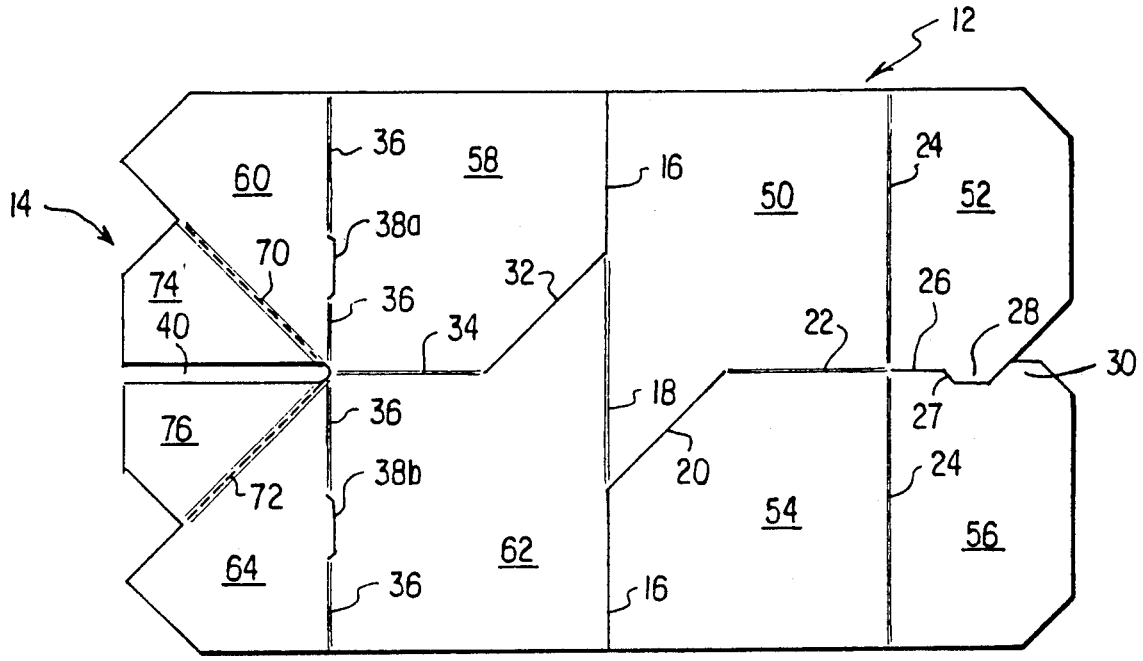
FIG. 1 is a plan view of a unitary blank of paperboard or other stiff, resilient and foldable sheet material from which the partition partition of this invention is fashioned.

Referring now to FIG. 1, the numeral 12 denotes generally the right half and the numeral 14 the left half of a generally rectangular unitary blank of paperboard. A pair of central, vertically disposed, colinear upper and lower cut lines 16 is interrupted by a central, colinear fold line 18. The lower end of an upwardly slanting cut line 20 runs from the upper end of lower cut line 16, with cut line 20 terminating adjacent the left end of a horizontally disposed fold line 22 in the right blank half. A pair of vertical colinear fold lines 24 are separated slightly near the middle of the blank, adjacent the right end of fold line 22. A horizontal and centrally located cut line 26 extends, at its left end, from a region adjacent the right end of fold line 22 to the right and terminates in a generally U shaped cut 27, the right hand portion of the later defining locking tabs 28 and 30.

Referring now to the left half 14 of the blank, a cut line 32 commences at the lower portion of the upper, vertically extending cut line 16 and extends slantingly leftwardly downwardly to a region adjacent the right end of horizontal fold line 34. The left end of 34 is located adjacent separated portions of a middle pair of colinear vertical fold lines 36, with upper pairs of fold lines 36 being interrupted, in both the upper and lower portions of the left half 14, by cut lines **38*a* and 38*b*. It will be observed that cut lines 38*a* and 38*b* are themselves colinear and are slightly laterally displaced, towards the right, from colinear fold lines 36. A slot 40 extends from a left free edge portion of the blank to a region adjacent the left end of fold line 34**. The peripheral edges of the blank are referred to as free edges.

The above described fold and cut lines define panels 50, 52, 54 and 56 in the right blank half, and also define panels 58, 60, 62 and 64 in the left blank half, with 45 degree fold lines 70 and 72 defining generally triangular glue flaps or panels 74 and 78 in respective panels 60 and 64.

Figure 5:
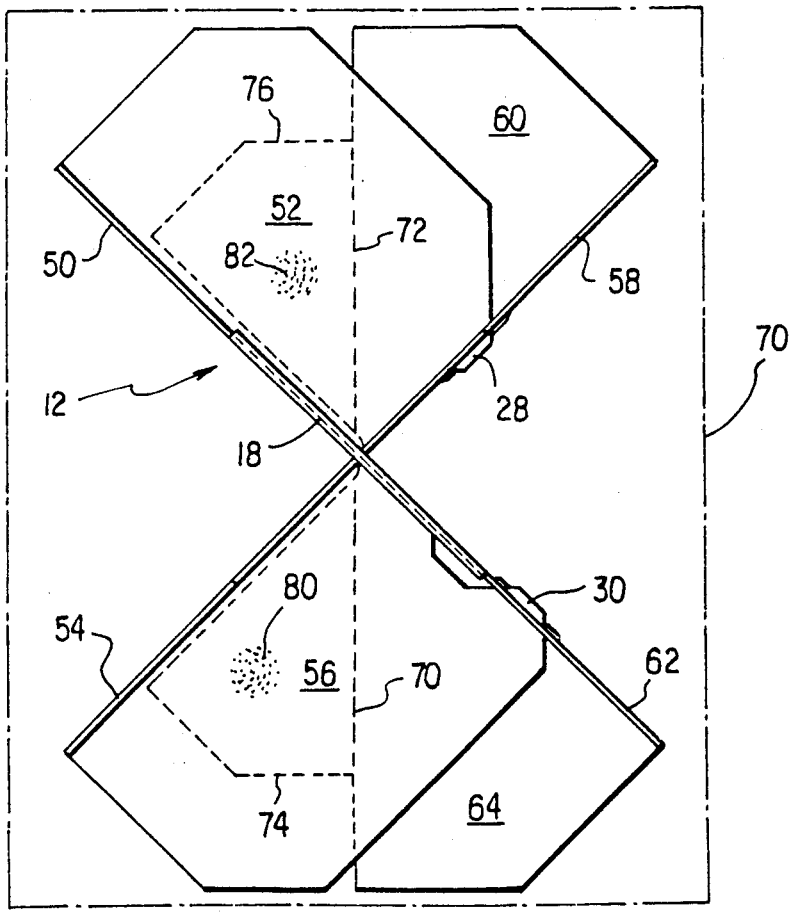
FIG. 5 is a sectional view taken along 5—5 of FIG. 4.
Figure 3:
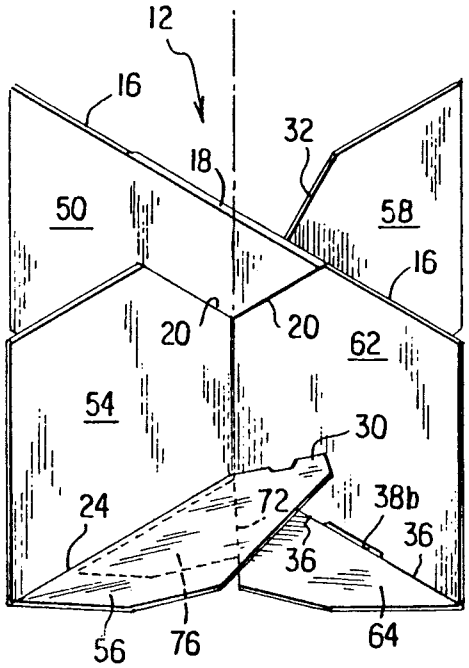
FIG. 3 is a perspective view showing how the partition is erected from a collapsed form.
Figure 2:
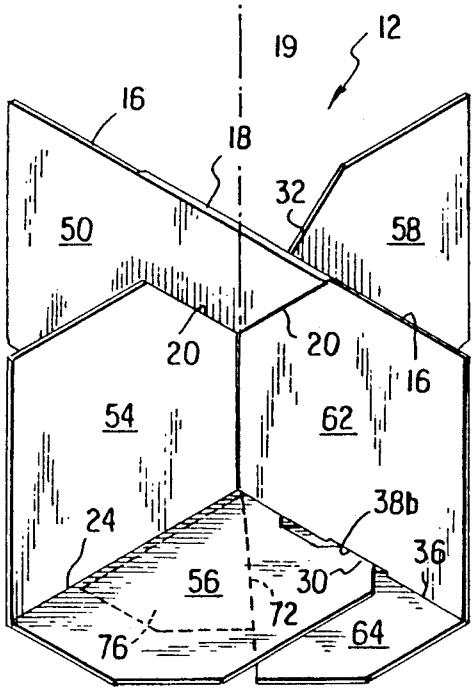
FIG. 2 is a perspective view of the assembled partition of this invention.

Referring now to FIGS. 2 and 3, these views illustrate the manner of erection of the blank to form the completed partition. Panels 50 and 52 are folded about one line 24, and 54 and 56 about another fold line 24. Panels 58 and 60 are folded about lower lines 36, while panels 62 and 64 are folded about upper fold lines 36. Adhesive flaps 74 and 76 are each provided with a dab of glue, 80 and 82 respectively, then bent back 180 degrees and glued to respective panels 56 and 52. The partition is now in a collapsed form and, upon opening by swinging panels 54 and 62 (as well as 50 and 58) apart, assumes the erected configuration or form of FIG. 2. At FIG. 2, a vertical axis 19 is substantially common to the fold line which joins panels 58 and 62 and also to the fold line which joins panels 50 and 54. The radially innermost (nearest axis 19) edges of panels 54 and 62 abut, as do the radially innermost edges of panels 58 and 50. These fold lines and abutment edges are substantially coincident with common vertical axis 19. It will be observed that fold line 70 of panel 60 extends radially outwardly from axis 19, as does fold line 72 on the opposite cell. It will further be observed that the adhesive panel 74 of lowermost bottom shelf panel 64 is on that part of panel 64 which is remote from fold line 36, which join panels 62 and 64. This is also seen at FIG. 5. The construction defines two cells, diagonally related, defined by substantially coplanar panels 50 and 62, and also substantially coplanar panels 54 and 58. The bottom shelf of each cell is defined by at least partially overlapping uppermost and lowermost panels.

FIG. 3 illustrates the configuration after panels 50 and 58 have been fully swung apart and panels 56 and 64 are swinging down (see curved arrows) just prior to locking tab 30 entering slot **38*b*. As shown at FIG. 5, the locking tabs enter their respective slots. From FIG. 3, it is easily visualized that prior to unfolding or erection, adhesive panel 74 is bent back against the bottom surface of panel 64** in the shipping or flattened form of the partition. The erected partition provides two diagonally opposite cells, each having a shelf. Each cell can be erected independently of the other.

Figure 4:
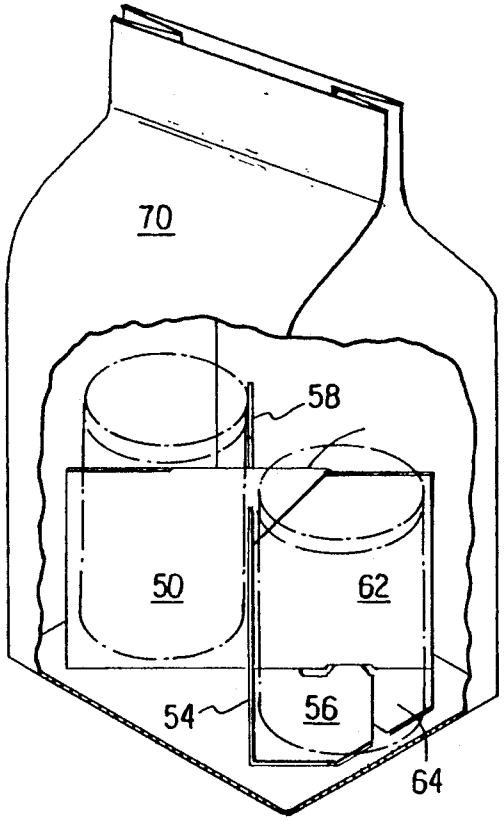
FIG. 4 is a partially broken perspective view illustrating the partition inside a paper bag, with items being separated and supported thereby indicated in phantom lines.

Referring now to FIGS. 4 and 5, the relationship between the sides of a typical paper bag 71 and the paperboard partition of this invention is shown. The phantom lines in FIG. 4 indicate items placed on the shelves of the partition, each shelf defined, respectively, by panels 52, 60, 76 and 56, 64, 74.

FIG. 5 shows the adhesive panels 74 and 76 having glue spots or dabs 80 and 82 which secure them to the bottom of respective panels 56 and 52. Panels 64 and 74 (and panels 60 and 76) are coplanar in erected form, and are bent 90 degrees relative to each other in the partition flattened or shipping configuration. The partition is erected and then placed in any suitable holder.

The terms horizontal, vertical and the like are employed to assist the reader to an understanding of the invention and are not intended as terms of limitation.

I claim:

1. A unitary paperboard blank for forming a paperboard partition, such as a partition for use in spacing and supporting items in a paper bag or the like, the blank being generally rectangular, the blank having a pair of spaced apart, colinear, central vertical cut lines, a central, vertical fold line between and colinear with said central vertical cut lines, said central, vertical fold and cut lines dividing the blank into left and right halves, the right blank half having a cut line extending slantingly upwardly from the upper end of the lower central cut line and terminating adjacent a horizontal fold line on said right blank half, a pair of colinear, vertically disposed fold lines in said right blank half, a horizontal cut line commencing, at its left and, adjacent to the right end of said horizontal fold line on said right blank half and having a cut at its right end which terminates at an edge of the blank, the left blank half having a cut line extending slantingly downward from the lower end of the upper central cut line and terminating adjacent a horizontal fold line on said left blank half, the latter terminating of its left and adjacent a plurality of left blank half, vertically disposed, colinear, spaced fold lines, a pair of vertically disposed, vertically spaced cut lines substantially colinear with vertically disposed fold lines on said left blank half, a horizontally disposed cutout of substantially uniform width colinear with said horizontal fold line on said left blank half, and an upper left panel above said cutout and a lower left panel below said cutout, said upper left pannel having a leftward and upward slanting fold line commencing at the right end of said cutout and extending to the edge of the blank, said lower left panel having a leftward and downward slanting fold line commencing at the right end of said cutout and extending to the edge of the blank.

2. The blank of claim 1 wherein said left and right blank half horizontal fold lines are colinear.

3. The blank of claim 1 wherein said plurality of left blank half vertically disposed fold lines is defined by four fold lines, two of said latter four fold lines being above a horizontal line which contains said left blank half horizontal fold line and being spaced apart by one of said left blank half, vertically disposed cut lines, the other two of said left blank half, colinear, vertically disposed fold lines being below said horizontal line and being separated by the other of said left blank half vertically disposed cut lines.

4. A paperboard partition for spacing and supporting items in a paper bag or the like, the partition formed of a single blank of paperboard and erectable from a flattened storage or shipping configuration, the partition including two at least substantially identical, diagonal supporting cells each of which is defined by two vertical panels meeting along a common vertical axis and a bottom shelf, the bottom shelf comprising two at least partially overlapping panels integral with a respective said vertical panel, said bottom shelf being orthogonal to each of said vertical panels, one of said bottom shelf overlapping panels carrying a locking tab which is received in a slot at the bottom of one of said vertical panels, the lowermost of said bottom shelf overlapping panels having a fold line therein which extends in a direction radially outwardly from said common vertical axis, that portion of said lowermost bottom shelf panel on that side of said glue fold line which is remote from the junction of said lowermost bottom shelf panel with its respective vertical panel provided with a glue spot to secure it to the uppermost of said bottom shelf panels.

5. The blank of claim 4 wherein said vertical panels are orthogonal to each other.

6. The blank of claim 4 wherein at least two vertical panels at the two diagonal cells are at least substantially coplanar.

7. The blank of claim 5 wherein one vertical panel of one cell is joined along a fold line at its upper edge to the upper edge of a vertical panel at the other of the cells.

* * * * *